US009975032B2

(12) United States Patent
Frey

(10) Patent No.: US 9,975,032 B2
(45) Date of Patent: May 22, 2018

(54) CONCUSSIVE HELMET

(71) Applicant: Mark Frey, Waccabuc, NY (US)

(72) Inventor: Mark Frey, Waccabuc, NY (US)

( * ) Notice: Subject to any disclaimer, the term of this patent is extended or adjusted under 35 U.S.C. 154(b) by 505 days.

(21) Appl. No.: 14/222,760

(22) Filed: Mar. 24, 2014

(65) Prior Publication Data

US 2015/0264991 A1 Sep. 24, 2015

(51) Int. Cl.
*A42B 3/00* (2006.01)
*A63B 71/10* (2006.01)
*A42B 3/06* (2006.01)

(52) U.S. Cl.
CPC ..... *A63B 71/10* (2013.01); *A42B 3/064* (2013.01)

(58) Field of Classification Search
CPC ..... A42B 3/00; A63B 71/10
See application file for complete search history.

(56) References Cited

U.S. PATENT DOCUMENTS 3,039,108 A * 6/1962 Lohrenz ..... A42B 3/10 2/412
3,413,656 A * 12/1968 Vogliano ..... A42B 3/14 2/412
3,877,076 A * 4/1975 Summers ..... A42B 3/124 2/414
4,012,794 A * 3/1977 Nomiyama ..... A42B 3/064 2/411
4,064,565 A * 12/1977 Griffiths ..... A42B 3/121 2/412
4,290,149 A * 9/1981 Aileo ..... A42C 2/007 2/414
4,307,471 A * 12/1981 Lovell ..... A42B 3/065 2/411
4,432,099 A * 2/1984 Grick ..... A42B 3/124 2/412
4,472,472 A * 9/1984 Schultz ..... A41D 31/005 2/410
4,555,816 A * 12/1985 Broersma ..... A42B 3/12 2/171.3
4,586,200 A * 5/1986 Poon ..... A42B 3/122 2/413
4,627,114 A * 12/1986 Mitchell ..... A42B 3/128 2/414
4,987,609 A * 1/1991 Zahn ..... F41H 1/04 2/411
5,068,922 A * 12/1991 Zahn ..... F41H 1/04 2/411
5,086,520 A * 2/1992 Arai ..... A42B 3/283 2/171.3
5,204,998 A * 4/1993 Liu ..... A42B 3/121 2/411
5,309,576 A * 5/1994 Broersma ..... A42B 3/128 2/412
5,581,819 A * 12/1996 Garneau ..... A42B 3/085 2/421
5,619,756 A * 4/1997 Garneau ..... A42B 3/066 2/411

(Continued)

*Primary Examiner* — Clinton T Ostrup
*Assistant Examiner* — Anne Kozak

(57) ABSTRACT

An improved protective helmet having an outer impact receiving shell, and inner protective shell and an intermediate piston interposed between the outer and inner shells which allows the inner shell to decelerate gradually when the outer shell is subjected to a sudden impact, and which, therefore, permits the brain to decelerate safely.

2 Claims, 3 Drawing Sheets

(56) References Cited

U.S. PATENT DOCUMENTS 5,669,079 A * 9/1997 Morgan ..... A42B 3/128 2/412
5,815,846 A * 10/1998 Calonge ..... A42B 3/121 2/413
5,833,796 A * 11/1998 Matich ..... A42C 2/00 156/212
5,950,244 A * 9/1999 Fournier ..... A42B 3/128 2/411
5,956,777 A * 9/1999 Popovich ..... A42B 3/065 2/412
5,978,972 A * 11/1999 Stewart ..... A42B 3/046 2/422
6,009,566 A * 1/2000 Hubbard ..... A41D 13/0512 2/421
6,052,835 A * 4/2000 O'Shea ..... A42B 3/0473 2/425
6,070,271 A * 6/2000 Williams ..... A42B 3/128 2/412
6,070,905 A * 6/2000 Renault ..... B60R 13/02 280/751
6,093,468 A * 7/2000 Toms ..... A41D 13/0158 2/22
6,314,586 B1 * 11/2001 Duguid ..... A42B 3/069 2/411
6,418,564 B1 * 7/2002 Sheridan ..... A42B 3/0486 2/410
6,453,476 B1 * 9/2002 Moore ..... A42B 3/125 2/412
6,536,052 B2 * 3/2003 Tao ..... A42B 3/122 2/411
6,658,671 B1 * 12/2003 Von Hoist ..... A42B 3/12 2/412
6,751,808 B2 * 6/2004 Puchalski ..... A42B 3/324 2/411
6,925,657 B2 * 8/2005 Takahashi ..... A42B 3/28 2/412
6,931,669 B2 * 8/2005 Ashline ..... A42B 3/0473 2/411
6,996,856 B2 * 2/2006 Puchalski ..... A42B 3/324 2/411
D521,191 S * 5/2006 Berger ..... D29/122
7,076,811 B2 * 7/2006 Puchalski ..... A42B 3/06 2/411
7,159,249 B2 * 1/2007 Dennis ..... A42B 3/08 2/414
7,207,071 B2 * 4/2007 Pierce ..... A42B 3/281 2/410
7,299,505 B2 * 11/2007 Dennis ..... A42B 3/12 2/410
7,328,462 B1 * 2/2008 Straus ..... A42B 3/067 2/411
7,376,981 B2 * 5/2008 Shida ..... A42B 3/326 2/424
7,574,754 B2 * 8/2009 Arai ..... A42B 3/0493 2/410
7,676,854 B2 * 3/2010 Berger ..... A42B 3/124 2/410
7,735,157 B2 * 6/2010 Ikeda ..... A42B 3/281 2/410
7,735,158 B2 * 6/2010 Tsurumi ..... A42B 3/283 2/410
7,748,059 B2 * 7/2010 Arai ..... A42B 3/0493 2/171.3
7,802,320 B2 * 9/2010 Morgan ..... A42B 3/124 2/411
7,832,023 B2 * 11/2010 Crisco ..... A42B 3/063 2/410
7,930,771 B2 * 4/2011 Depreitere ..... A42B 3/124 2/410
9,032,558 B2 * 5/2015 Leon ..... A42B 3/12 2/411
2002/0023291 A1 * 2/2002 Mendoza ..... A42B 3/064 2/412
2004/0117896 A1 * 6/2004 Madey ..... A42B 3/12 2/411
2007/0190293 A1 * 8/2007 Ferrara ..... B29C 45/0053 428/166
2008/0155735 A1 * 7/2008 Ferrara ..... A01N 25/18 2/412
2010/0186150 A1 * 7/2010 Ferrara ..... A42B 3/128 2/412
2010/0258988 A1 * 10/2010 Darnell ..... A42B 3/064 267/141
2010/0295221 A1 * 11/2010 Kligerman ..... F16F 1/373 267/140.11
2012/0060251 A1 * 3/2012 Schimpf ..... A42B 3/064 2/5

* cited by examiner

CONCUSSIVE HELMET

FIELD OF INVENTION

This invention relates to helmets and is particularly directed to improved protective helmets for absorbing concussive forces encountered during sports events, motor ear racing, construction work and the like.

PRIOR ART

It is well known that serious and sometimes fatal head injuries are often sustained by persons engaged in activities, such as sports events, motor car racing, construction work and the like. Accordingly, it is common practice to require protective helmets for persons engaging in such activities. The prior art protective helmets seek to negate impact forces by absorbing or deflecting the majority of the impact. However, the prior art protective helmets miss the critical mechanism for brain injury. It is not the impact, but the sudden deceleration which causes brain injuries. This is the difference between laying your head on a pillow and laying it on a brick. The brick causes instant deceleration, whereas the pillow allows gradual deceleration. Unfortunately, none of the prior art protective helmets provide for gradual deceleration. Thus, none of the prior art protective helmets have been entirety satisfactory.

BRIEF SUMMARY AND OBJECTS OF INVENTION

These disadvantages of the prior art are overcome with the present invention and an improved protective helmet is provided which allows gradual deceleration of the head in response to a sudden impact, thereby allowing the brain to decelerate safely.

These advantages of the present invention are preferably attained by providing an improved protective helmet having an outer impact receiving shell, and inner protective shell and an intermediate piston interposed between the outer and inner shells which allows the inner shell to decelerate gradually when the outer shell is subjected to a sudden impact, and which, therefore, permits the brain to decelerate safely.

Accordingly it is an object of the present invention to provide an improved protective helmet.

Another object of the present invention is to provide an improved protective helmet allows gradual deceleration of the head in response to a sudden impact.

An additional object of the present invention is to provide an improved protective helmet is provided which allows gradual deceleration of the head in response to a sudden impact, thereby allowing the brain to decelerate safely.

A specific object of the present invention is to provide an improved protective helmet having in outer impact receiving shell, and inner protective shell and an intermediate piston interposed between the outer and inner shells which allows the inner shell to decelerate gradually when the outer shell is subjected to a sudden impact, and which, therefore, permits the brain to decelerate safely.

These and other objects and features of the present invention will be apparent from the following detailed description, taken with reference to the accompanying drawing.

DETAILED DESCRIPTION OF THE INVENTION

Figure 1:
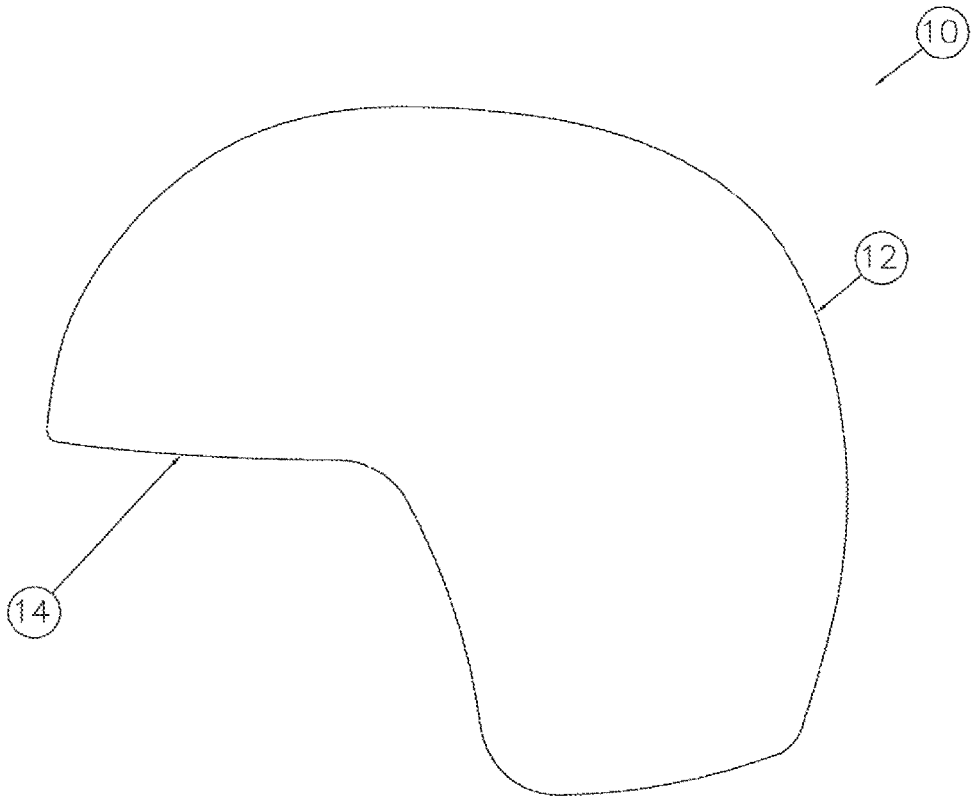
FIG. 1 is a side view of a protective helmet embodying the present invention.
Figure 2:
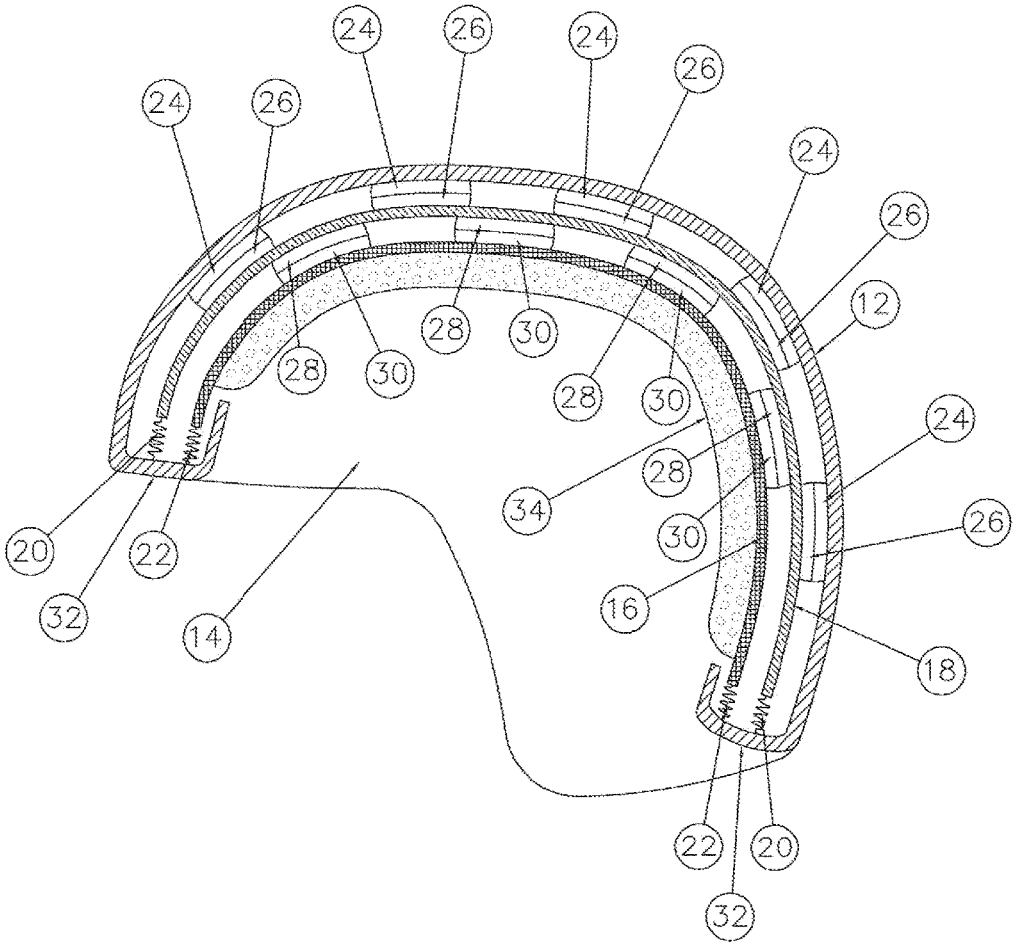
FIG. 2 is a vertical section through the protective helmet of FIG. 1.

In that form of the present invention chosen for purposes of illustration, FIGS. 1 and 2 show a protective helmet, indicated generally at 10, having a generally spherical outer shell 12 formed of rigid material and having an opening 14 to permit entry and removal of a wearer's head and to provide visibility when the helmet is worn. A generally spherical inner shell 16 formed of rigid or semi-rigid material and a generally spherical piston 18 are located within the outer shell 12 and are freely and independently movable in any direction within the outer shell 12. Resilient means, such as springs 20 and 22, serve to maintain the inner shell 16 and piston 18 in generally centered positions within the outer shell 12. Motion-retarding means, such as brake pads 24 and 26 are mounted between the outer shell 12 and the piston 18 to retard relative movement between the outer shell 12 and piston 18, while additional motion-retarding means, such as brake pads 28 and 30, are mounted between the piston 18 and the inner shell 16 and serve to retard relative movement between the piston 18 and the inner shell 16. The pads of braking material 24, 26, 28 and 30 may be formed of material similar to the pads used in automotive brake systems. Also, preferably, the motion-retarding means 28 and 30 are off-set from the motion-retarding means 24 and 26 to cause shocks to the outer shell 12 to be delivered indirectly to the inner shell 16. The outer shell 12 is provided with generally L-shaped end pieces 32, which serve to retain the piston 18 and inner shell 16 within the outer shell 12. Finally, padding 34 is provided on the inner shell 16 to provide additional cushioning and to comfortably lit the helmet 10 to the wearer's head.

Figure 3:
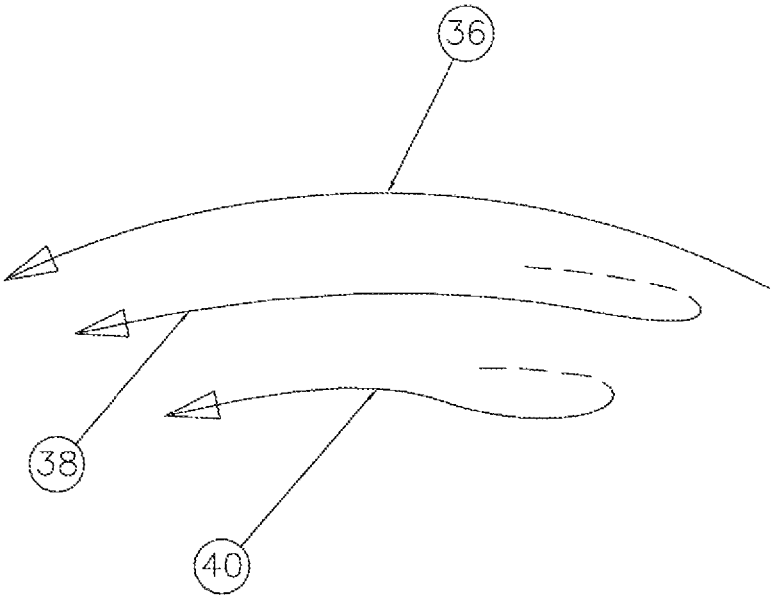
FIG. 3 is a diagrammatic representation showing how the helmet of FIG. 1 reacts to a sudden impulse.

In use, when a sudden impact is delivered to the protective helmet 10, it tends to drive the outer shell 12 in the direction of the impact, as indicated by arrow 36 in FIG. 3. Initially, inertia will cause the piston 18 to remain stationary, as indicated by the dashed portion of arrow 38 in FIG. 3 However, shortly after the impact, the force of the impact will be transmitted through the brake pads 24 and 26 to cause the piston 18 to also move in the direction of the impact, as seen by the solid portion of arrow 38. However since the brake pads 24 and 26 allow some movement therebetween, the force of the impact which is delivered to the piston 18 will be significantly diminished. Also, the force from the outer shell 12 must travel some distance through the piston 18 in order to reach brake pads 28 and, hence, to be delivered through brake pads 28 and 30 to the inner shell 16. This further diminishes the force which is delivered to the inner shell 16. Similarly, when the piston begins to move, the inner shell 16 will, initially, remain stationary, as indicated by the dashed portion of arrow 40 in FIG. 3, until the force of the impact is delivered through brake pads 28 and 30 to cause the inner shell 16 to also move in the direction of the impact, as seen by the solid portion of arrow 40. Again, since the brake pads 28 and 30 allow some movement therebetween, the force of the impact which is delivered from the piston 18 to the inner shell 16 will be further diminished. Finally, the padding 34 will further reduce the force of the initial impact which is delivered to the wearer's head. Thus, the force of the initial impact is retarded and reduced between the outer shell 12 and tie piston 18 and is further retarded and reduced between the piston 18 and the inner shell 16 and is still further reduced by the padding 34 before being delivered to the wearer's head. This greatly reduces the effect of the impact and serves to protect the wearer's head from concussion and other such injuries.

If desired, radio earphones or the like may be mounted within the inner shell 18. Moreover, numerous variations other variations and modification can obviously be made without departing from the spirit of the present invention. Therefore, it should be dearly understood that the forms of the present invention described above and shown in the figures of the accompanying drawing are illustrative only and are not intended to limit the scope of the present invention.

What is claimed is:

1. A protective helmet comprising:

an outer shell;

an inner shell;

the outer shell having an anterior end terminating in an anterior L-shaped end piece; said anterior L-shaped end piece extending laterally to the interior of the protective helmet to a position posterior to the internal shell, wherein said anterior L-shaped end piece bends and extends vertically to a terminal portion parallel to an outermost portion of the outer shell so as to retain said inner shell within said outer shell, the outer shell having a posterior end terminating in a posterior L-shaped end piece extending laterally to the interior of the protective helmet to a position anterior to the internal shell, wherein said posterior L-shaped end piece bends and extends vertically to a terminal portion parallel to an outermost portion of the outer shell so as to retain said inner shell within said outer shell;

the inner shell having an anterior end attached by an anterior spring to the anterior L-shaped end piece on the anterior end of the outer shell, the inner shell having a posterior end attached by a posterior spring to the posterior L-shaped end piece on the posterior end of the outer shell, the anterior and posterior springs allow the inner shell to be freely movable within said outer shell;

a piston having an anterior end attached by a second anterior spring to the anterior L-shaped end piece on the anterior end of the outer shell, the piston having a posterior end attached by a second posterior spring to the posterior L-shaped end piece on the posterior end of the outer shell, the second anterior spring and second posterior spring allow the piston to be freely movable within said outer shell;

the piston being arranged between said outermost portion of the outer shell and said inner shell;

and a plurality of lower brake pads arranged between a lower surface of the piston and the inner shell, and a plurality of upper brake pads arranged between an upper surface of the piston and the outer shell, each brake pad of the plurality of lower brake pads being staggered from each brake pad of the plurality of upper brake pads such that an anterior end of each brake pad of the plurality of lower brake pads is near a posterior end of each brake pad of the plurality of upper brake pads, and a posterior end of each brake pad of the plurality of lower brake pads is near an anterior end of each brake pad of the plurality of upper brake pads.

2. The protective helmet of claim 1, further comprising:

a padding layer lining said inner shell which is configured to provide cushioning and support for fitting the helmet to a wearer's head.

* * * * *